US010399765B2

(12) United States Patent
Mintz et al.

(10) Patent No.: US 10,399,765 B2
(45) Date of Patent: Sep. 3, 2019

(54) SYSTEMS AND METHODS FOR SAFELY TRANSPORTING GRANULAR MATERIAL

(71) Applicant: Transload Equipment, LLC, Corpus Christi, TX (US)

(72) Inventors: Michael Mintz, Corpus Christi, TX (US); Ron Wheaton, Corpus Christi, TX (US)

(73) Assignee: Transload Equipment, LLC, Corpus Christi, TX (US)

( * ) Notice: Subject to any disclaimer, the term of this patent is extended or adjusted under 35 U.S.C. 154(b) by 109 days.

(21) Appl. No.: 15/494,025

(22) Filed: Apr. 21, 2017

(65) Prior Publication Data

US 2017/0225874 A1 Aug. 10, 2017

Related U.S. Application Data

(63) Continuation-in-part of application No. 15/002,254, filed on Jan. 20, 2016, now abandoned.

(51) Int. Cl.
*B65D 88/62* (2006.01)
*B65D 88/28* (2006.01)
(Continued)

(52) U.S. Cl.
CPC ..... *B65D 83/06* (2013.01); *B65D 88/1618* (2013.01); *B65D 88/1643* (2013.01);
(Continued)

(58) Field of Classification Search
CPC .... B65D 88/1618; B65D 88/62; B65D 88/20; B65D 88/703; B65D 77/0473;
(Continued)

(56) References Cited

U.S. PATENT DOCUMENTS 3,372,725 A * 3/1968 Voorhees ..... B65D 7/24 137/585
3,789,897 A * 2/1974 Saito ..... B65D 88/1618 222/105
(Continued)

FOREIGN PATENT DOCUMENTS

CA 2427663 A1 * 11/2004 ..... B65D 88/08
DE 3611188 A1 * 10/1987 ..... B65D 88/1618
(Continued)

OTHER PUBLICATIONS

English translation of WO-9742101-A1.*
English translation of FR-2512790-A1.*

*Primary Examiner* — Mollie Impink
(74) *Attorney, Agent, or Firm* — Clayton, McKay & Bailey, PC

(57) ABSTRACT

Systems and methods are provided for safely and efficiently transporting granular material. In one embodiment, a container for granular material is provided. The container can have a top plate and a bottom plate that are coupled to one another via one or more high-strength fabric sleeves. The bottom plate can include a discharge valve for discharging the granular material in the container. The container can also include a discharge bladder that, when inflated, biases granular material within the container toward the discharge valve. The container can also include at least one barrier positioned proximate the discharge valve such that the barrier prevents at least a portion of the discharge bladder from entering the discharge valve. The barrier can allow sand or other granular material to pass through the barrier and exit through the discharge valve.

19 Claims, 11 Drawing Sheets

(51) Int. Cl.

| | |
|---|---|
| ***B65D 83/06*** | (2006.01) |
| ***B65D 88/22*** | (2006.01) |
| ***B65D 88/16*** | (2006.01) |
| ***B65D 90/62*** | (2006.01) |
| ***E21B 41/00*** | (2006.01) |
| ***B65D 88/20*** | (2006.01) |
| ***B65D 90/20*** | (2006.01) |
| *E21B 43/267* | (2006.01) |

(52) U.S. Cl.
CPC ..... *B65D 88/1656* (2013.01); *B65D 88/1668* (2013.01); *B65D 88/1687* (2013.01); *B65D 88/20* (2013.01); *B65D 88/22* (2013.01); *B65D 88/28* (2013.01); *B65D 88/62* (2013.01); *B65D 90/205* (2013.01); *B65D 90/626* (2013.01); *E21B 41/00* (2013.01); *E21B 43/267* (2013.01)

(58) Field of Classification Search
CPC ..... B65D 77/0466; B65D 77/0486; B65D 90/626; B65D 19/12
See application file for complete search history.

(56) References Cited

U.S. PATENT DOCUMENTS

| | | | | | |
|---|---|---|---|---|---|
| 4,036,361 | A * | 7/1977 | Jacobson | B65D 88/20 | 206/597 |
| 5,497,897 | A * | 3/1996 | Alack | B65D 19/02 | 220/320 |
| 5,690,466 | A * | 11/1997 | Gaddis | B60P 1/40 | 296/184.1 |
| 6,902,061 | B1 * | 6/2005 | Elstone | B65D 19/02 | 206/596 |
| 7,798,711 | B2 * | 9/2010 | Plunkett | B65D 75/5877 | 383/11 |
| 2001/0027826 | A1 * | 10/2001 | Carpenter | B65D 88/1618 | 141/313 |
| 2010/0000994 | A1 * | 1/2010 | Nelson | B65D 90/626 | 220/9.1 |

FOREIGN PATENT DOCUMENTS

| | | | | |
|---|---|---|---|---|
| EP | 1544132 | A2 * | 6/2005 | B65D 88/10 |
| FR | 2076282 | A5 * | 10/1971 | B65D 88/62 |
| FR | 2512790 | A1 * | 3/1983 | B65D 88/62 |
| WO | WO-8203839 | A1 * | 11/1982 | B65D 88/62 |
| WO | WO-9742101 | A1 * | 11/1997 | B65D 88/1618 |

* cited by examiner

SYSTEMS AND METHODS FOR SAFELY TRANSPORTING GRANULAR MATERIAL

DESCRIPTION OF THE EMBODIMENTS

Field of the Embodiments

The embodiments herein relate generally to systems and methods for safely transporting granular material, and, more specifically, to improved systems and methods for safely transporting granular agricultural and industrial materials such as cement, barite, and sand for use in hydrocarbon fracking operations.

BACKGROUND

Working with certain types of granular material can pose significant health risks. According to the U.S. Occupational Safety & Health Administration ("OSHA"), inhalation of small crystalline silica particles puts workers at risk for silicosis, lung cancer, chronic obstructive pulmonary disease, as well as liver, heart, and kidney disease. With the increase of hydraulic fracturing ("fracking") over the past 5-10 years, the instances of sicknesses and deaths due to silica inhalation have rapidly increased. Many fracking sites fail to meet current OSHA standards. Moreover, OSHA has proposed a new rule lowering the permissible exposure limit of respirable crystalline silica per cubic meter of air. This lower limit will impact almost any industry that involves transporting or otherwise using silica.

Fracking is a process for stimulating an oil well by fracturing underground rock using a pressurized liquid. The pressurized liquid consists primarily of water mixed with a proppant. A typical proppant is sand, such as "frac sand," although other granular materials can be used as well. The proppant functions to maintain an induced hydraulic fracture open such that the desired oil or gas can be extracted. A single fracking well can require several thousand tons of frac sand.

Frac sand is mined and processed in a plant to improve its performance characteristics. The sand then gets transported from the plant to the fracking site. This transportation process can involve trains, ships, trucks, conveyors, and other transportation methods. Pneumatic pipe systems and conveyors are routinely used to transport sand from one container to another—for example, from a rail car to a truck or from a truck to a storage facility. Pneumatic and conveyor transfers allow silica particles to permeate the air in the surrounding area, causing a potential health hazard to any workers nearby.

In addition to the health hazards, the typical processes for transporting frac sand have additional drawbacks. For example, a container (e.g., a rail car or a truck) designed to hold frac sand may not be useful for carrying other items. That is, once the load of frac sand has been deposited, the rail car or container cannot be used for another purpose; instead, it must be returned to a location where it can be refilled with frac sand. The lack of reusability increases transportation costs and, as a result, the overall cost of fracking.

Therefore, a need exists for systems and methods for safely and efficiently transporting granular material. More specifically, a need exists for systems and methods for transporting granular material in a manner that limits respirable silica emissions, eliminates harmful pneumatic transfers, and provides lower transport costs.

SUMMARY

Embodiments described herein include systems and methods for safely and efficiently transporting granular material. In one embodiment, a method includes providing an expandable container in an unexpanded state, expanding the expandable container from the unexpanded state to an expanded state, and depositing granular material within the expandable container via an input valve. In this embodiment, the expandable container includes at least a top plate, a bottom plate, an outer material coupled to the top and bottom plates, an input valve associated with the top plate, and a discharge valve associated with the bottom plate. The expandable container can also include a containment bladder for holding of the granular material within the container and protecting it from the elements, and a discharge bladder for assisting in discharging the granular material from the container.

In another embodiment, the method also includes transporting the expandable container. The method can further include discharging granular material from the expanded container via the discharge valve. The discharge bladder may be inflated in a manner that urges or biases the granular material within the containment bladder toward the discharge valve. Discharging the granular material may cause the expandable container to return to its unexpanded state. Once in its unexpanded state, the expandable container may be stacked on top of a similar expandable container, also in an unexpanded state, for transporting. This can, for example, require half or fewer train cars to return the expandable containers than is needed for transporting the full containers.

In one embodiment, the expandable container includes a restraint device removably coupled to the top and bottom plates and/or support members associated with the top and bottom plates. Expanding the expandable container may include the step of removing the restraint device.

In yet another embodiment, an expandable container is provided for safely transporting granular material. The expandable container can include a top plate, a bottom plate, an outer material coupled to the top and bottom plates, an input valve associated with the top plate, and a discharge valve associated with the bottom plate. Furthermore, the expandable container can be expanded by applying opposing forces to the top and bottom plates, respectively.

The expandable container may include a containment bladder coupled to the top and bottom plates. The outer material may include at least one Kevlar or Kevlar-reinforced band, and/or may be coupled to the top and bottom plates via retaining rings. The input valve and/or discharge valve may include a spring-loaded plate. A discharge bladder may be included, and can be positioned outside the containment bladder and inside the outer material. The discharge bladder can be configured to be inflated via an inflation port. Once inflated, the discharge bladder can provide a shape that biases the granular material within the containment bladder toward the discharge valve.

The expandable container can also include a restraint device that can be removably coupled to the top and bottom plates, thereby limiting the vertical expansion of the container. The top and/or bottom plates of the expandable container can also include reinforcement members. These reinforcement members can be coupled to the input and/or discharge valves, respectively.

In another embodiment, a container for granular material is provided. The container can have a top plate and a bottom plate. The top plate and bottom plate can be coupled to one another via a fabric sleeve. Multiple fabric sleeves can be used to couple the top and bottom plates to one another. As explained further below, the word "fabric" can encompass any type of non-rigid or partially rigid material, such as KEVLAR or a steel- or carbon-fiber-reinforced fabric material. The bottom plate can include a discharge valve for discharging the granular material in the container.

The container can also include a discharge bladder that, when inflated, biases granular material within the container toward the discharge valve. The container can also include at least one barrier positioned proximate the discharge valve such that the barrier prevents at least a portion of the discharge bladder from entering the discharge valve. The barrier can allow sand or other granular material to pass through the barrier and exit through the discharge valve.

The barrier can be frustoconically shaped in one example. This includes a plurality of barriers that, when view collectively, form the basic shape of a frustrum or a cone. For example, the barrier can include a plurality of members extending away from the discharge valve. In one example, at least one of the members is mounted such that it extends away from the discharge valve, wherein a proximate end of the member is positioned closer to a longitudinal axis of the container than a distal end of the member. The barrier can further include at least one ring mounted to at least two of the plurality of members.

In one embodiment, a sealed container is provided for granular material. The sealed container can include a rigid upper portion having an inlet and a rigid bottom portion having an outlet. The container can also include a first, second, and third fabric sleeve. The first fabric sleeve can have a first open end and a second open end, with the first open end coupled to the inlet of the upper portion and the second open end coupled to an upper mounting location of the upper portion. The second fabric sleeve can have a third open end and a fourth open end, with the third open end coupled to the outlet of the bottom portion and the fourth open end coupled to a lower mounting location of the bottom portion. The third fabric sleeve can have a fifth open and a sixth open end, with the fifth open end coupled to the second open end of the fabric sleeve via the upper mounting location of the upper portion, and the sixth open end coupled to the fourth open end of the second fabric sleeve via the lower mounting location of the bottom portion.

The container can also include a fourth fabric sleeve having a seventh open end and an eighth open end. The seventh open end can be coupled to the fifth open end of the third fabric sleeve and the second open end of the first fabric sleeve via the upper mounting location of the upper portion. The eighth open end can be coupled to the sixth open end of the third fabric sleeve and the fourth open end of the second fabric sleeve via the lower mounting location of the bottom portion.

In one example, the upper and lower mounting locations can include a pair of clamp rings spaced to receive a compression strap therebetween. The compression strap can be made from metal but tightened around the container to retain one or more layers of fabric against the container. For example, coupling to the upper or lower mounting location can include compressing a portion of at least one of the first, second, or third fabric sleeves between the pairs of clamp rings via a compression strap.

In another embodiment, a container for granular material is provided that includes a cylindrical top plate and a cylindrical bottom plate. The bottom plate can include a discharge valve centered in the bottom plate. The bottom plate can also include a pair of fork lift boots coupled to the bottom plate on either side for the discharge valve.

In one example, each of the pairs of fork lift boots is welded to the bottom plate. The fork lifts boots can be open on either end, such that they are accessible by a forklift from multiple directions. The top and bottom plates can each include a plurality of slots, where each slot is configured to couple to a lift tube for lifting or anchoring the container. In one example, the top plate includes a hollow metal tube coupled along a perimeter of the plate. The bottom plate can include a similar hollow metal tube along its perimeter.

Both the foregoing general description and the following detailed description are exemplary and explanatory only and are not intended to restrict the scope of the invention as claimed.

BRIEF DESCRIPTION OF THE DRAWINGS

The accompanying drawings, which are incorporated in and constitute a part of this disclosure, illustrate various embodiments and aspects of the present invention. In the drawings.

DETAILED DESCRIPTION

Reference will now be made in detail to the present exemplary embodiments, including examples illustrated in the accompanying drawings. Wherever possible, the same reference numbers will be used throughout the drawings to refer to the same or like parts.

The containers described herein may be used to store and transport granular material, such as frac sand. In one example embodiment, the container may have a containment volume of about 500 cubic feet. In that example, the container may be about 10 feet tall in its expanded state and have a diameter of about 8 feet. The height and diameter, and therefore the containment volume, of the container may be varied according to the particular transportation needs of a project. For example, the container may have an expanded height of between 6-14 feet, and may have a diameter of between 4-12 feet. Other sized may be used as well, and these examples are not intended to limit this disclosure in any way.

Figure 1:
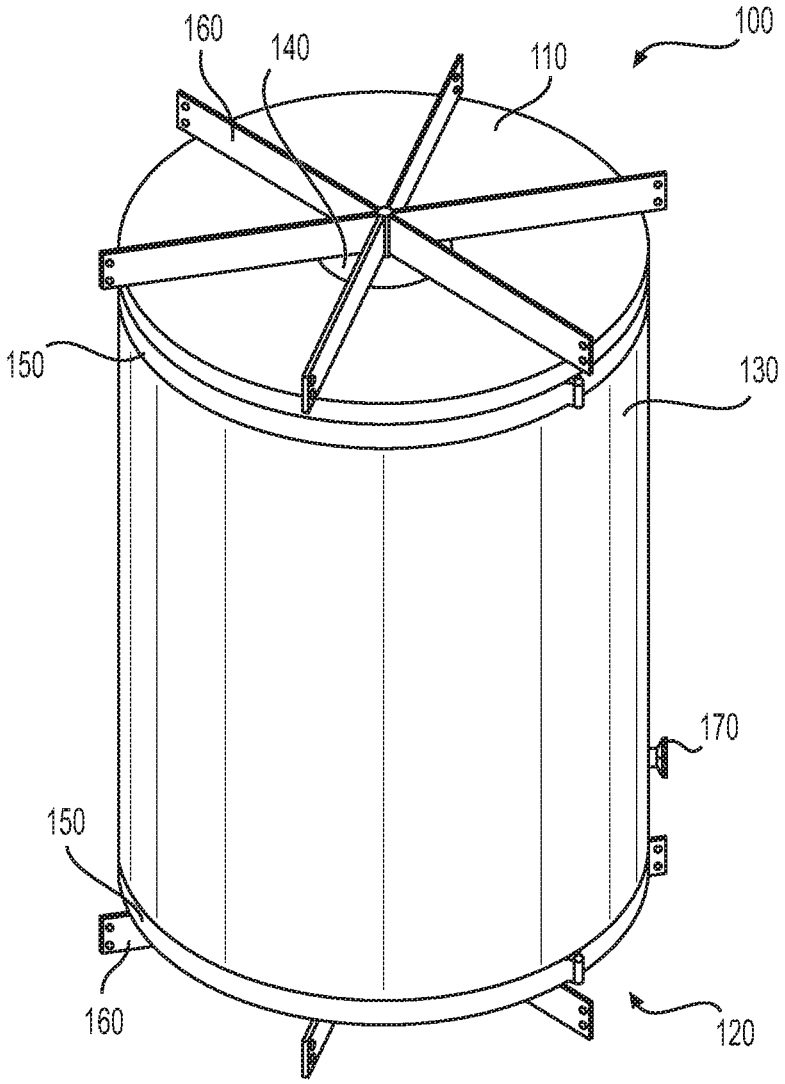
FIG. 1 is an illustration of an example embodiment of an expandable container for transporting granular material.

FIG. 1 is an illustration of an example embodiment of an expandable container 100 for transporting granular material. The expandable container includes a top plate 110 and bottom plate 120, with an outer material 130 coupled to the top and bottom plates 110, 120. The top and bottom plates 110, 120 may be constructed from a rigid material, such as steel or other metals and alloys. The outer material 130 can be coupled to the top and bottom plates 110, 120 via locking rings 150. Locking rings 150 secure the outer material 130 to the top and bottom plates 110, 120 by applying a clamping force. Locking rings 150 may fit flush with the side of the top and/or bottom plates 110, 120, or may fit at least partially inside a slot provided in the top and/or bottom plates 110, 120. Locking rings 150 may be tightened by mechanical means to a tension sufficient to retain the outer material 130 during use.

The outer material 130 can be constructed from a robust yet flexible material such as, for example, Kevlar or other material having similarly high elastic modulus and/or tensile strength measurements. For example, the outer material 130 can be made from a fabric having an elastic modulus of between about 100 and 200 GPa. In some examples, the outer material 130 can be made from a material having a tensile strength of between about 2000 and 4000 MPa. In other examples, material having characteristics outside of these ranges can be used. However, a material with these characteristics can prevent bulging and thereby maintain the uniform cross-sectional diameter of the container as the outer material. The outer material 130 functions to contain the contents of the expandable container 100, including any internal bladders or containment vessels. The outer fabric material 130 can be stronger than steel, on a per-weight basis. However, it also provides flexibility such that the expandable container 100 can be expanded or contracted in an efficient and reliable manner. At the same time, however, the outer material 130 is strong enough to resist tearing or rupturing during use, which may involve heavy machinery and large forces or loads.

For increased strength and overall robustness of the container, support members 160 may be coupled to the top plate 110 and/or bottom plate 120. The support members 160 provide increased rigidity of the top and bottom plates 110, 120, and enable multiple expandable containers 100 to be stacked on top of one another. The support members 160 also provide a mechanism to manipulate the expandable container 100 itself. For example, the loading process may require the top plate 110 to be lifted and/or vibrated to efficiently fill the containment volume with granular material. In this scenario the top plate 110 can be gripped via support members 160 and manipulated as needed. The container 100 can be filled with sand while lifted, allowing the weight of the sand to expand the container 100 downward. Then the full container 100 can 100 can be placed on a train car or other transport.

Additionally, support members 160 can be used to temporarily fix the height of the expandable container 100. As discussed further with respect to FIG. 4A, the support members 160 can be connected via an additional member that limits the expansion or contraction abilities of the expandable container 100 while connected. Finally, the support members 160 may also be coupled to the input valve 140 and/or discharge valve, as discussed in more detail below.

With respect to FIG. 1, a discharge bladder valve 170 is also shown. The discharge bladder valve 170 can be used to provide fluid, such as compressed air, to one or more discharge bladders inside the expandable container 100. This functionality is discussed in more detail below with respect to FIG. 3.

Figure 2:
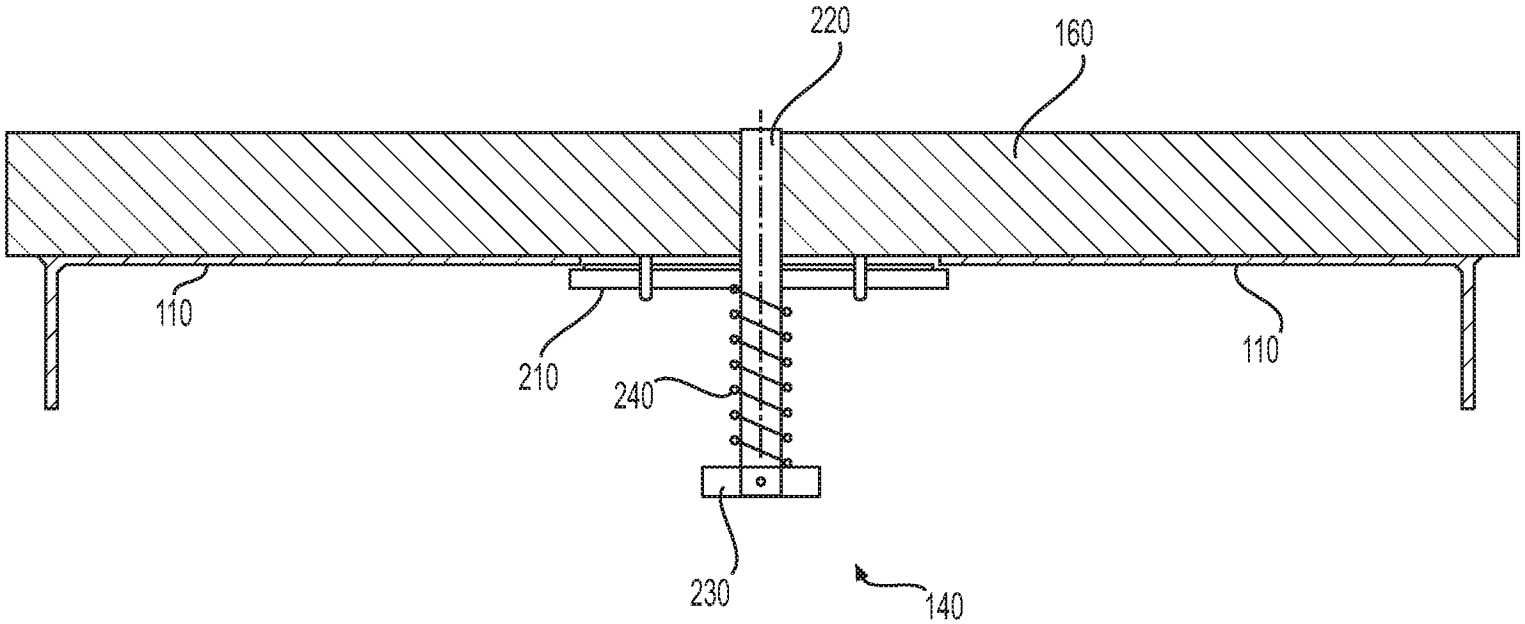
FIG. 2 is a cross-sectional view of an example embodiment of an input valve of an expandable container.

FIG. 2 is a cross-sectional view of an example embodiment of input valve 140. The same architecture and components may be used for a discharge valve as well—therefore, any reference herein with respect to an "input" valve, or its components, may be applied in similar fashion to a discharge valve. FIG. 2 shows a support member 160 coupled to both the top plate 110 and the input valve 140. The support member 160 may be coupled to the top plate 110 via fasteners or welds along the length, or a portion of the length, of the support member 160. The support member 160 may be coupled to the input valve 140 via valve shaft 220. Valve shaft 220 can be provided as a solid or hollow bar of metal or other high-strength material in order to provide a solid base upon which the input valve 140 functions. The support member 160 can be coupled to valve shaft 220 by welding, fastening, or other mechanical connection techniques.

A valve plate 210 can be used to control the flow of material into or out of a valve. The valve plate 210 can be provided as a circular disk with a hole that accommodates valve shaft 220, such that the valve plate 210 can slidably move along the valve shaft 220. A biasing mechanism, such as a spring 240, can be used along at least a portion of the valve shaft 220. Spring 240 biases the valve plate 210 in a manner that will cause the valve plate 210 to sit flush with the top plate 110 in its resting position (i.e., when no external forces are being applied to the valve plate 210). A valve pin 230 can be provided along the valve shaft 220 to abut one end of the spring 240, while the other end of the spring 240 abuts the valve plate 210.

To operate the input valve 140, the valve plate 210 is depressed such that it moves along the valve shaft 220 toward the valve pin 230, compressing the spring 240. In practice, the valve plate 210 can be depressed by a loading apparatus. For example, the nozzle of a hopper, tube, or pipe carrying granular material can be shaped to contact and depress the valve plate 210. In some embodiments one mechanism is used to depress the valve plate 210 while a separate component provides the granular material. Any device that depresses the valve plate 210 toward the valve pin 230 can be used to open the input valve 140.

Figure 3:
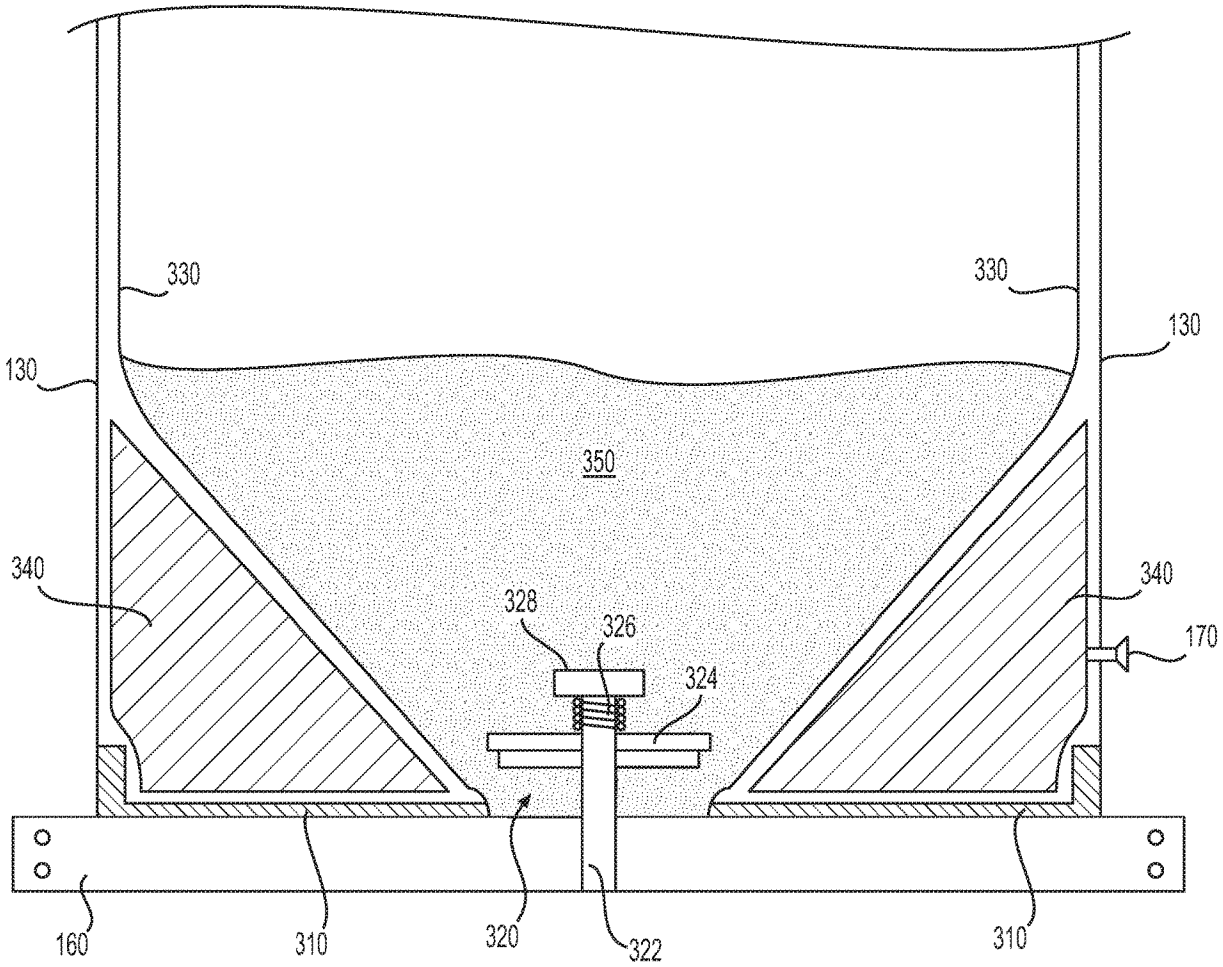
FIG. 3 is a cross-sectional view of an example embodiment of an expandable container having a discharge valve and discharge bladder.

As mentioned above, a discharge valve may incorporate the same, or similar, components described in FIG. 2 with respect to the input valve 140. FIG. 3 shows a cross-sectional view of an example embodiment of an expandable container having a discharge valve 320 and discharge bladder 340. Similar to the input valve 140 described with respect to FIG. 2, the discharge valve 320 of FIG. 3 includes a valve shaft 322, valve plate 324, valve pin 328, and a spring 326. The discharge valve 320 is operated by depressing or otherwise moving the valve plate 324 along the valve shaft 322 toward the valve pin 328, compressing the spring 326 and exposing an opening in the bottom plate 310. The discharge valve 320 of FIG. 3 is shown in an open position, where the granular material 350 may freely flow out.

FIG. 3 also shows a containment bladder 330 having an amount of granular material 350. The containment bladder 330 is located within the outer material 130 and may be constructed from a gas-impermeable membrane, such as nylon. Other materials may be used as well. Suitable materials include any material that is sufficiently pliable and strong, and does not allow any granular material, dust, or gases to escape through the material. The containment bladder 330 can be coupled to the outer material 130, support members 160, or the top and/or bottom plates 110, 310. In the embodiment depicted in FIG. 3, the containment bladder 330 is coupled to at least the bottom plate 310.

FIG. 3 also shows discharge bladder 340. Discharge bladder 340 is shown in two portions in FIG. 3—each portion roughly triangular in cross section. These two portions represent a cross-sectional view of a single discharge bladder 340 that wraps around the expandable container 100. In this embodiment the discharge bladder 340 is one bladder; however, in other embodiments the discharge bladder 340 may include multiple bladders working in combination with one another. In either case, the bladders may be inflated with a fluid, such as air or another gas, via discharge bladder valve 170.

Discharge bladder 340 can be inflated during the discharge process when the granular material 350 begins to run low. One purpose of the discharge bladder 340 is to prevent granular material 350 from remaining trapped inside the containment bladder 330 due to the flat-bottomed shape of the expandable container 100. Discharge bladder 340 fills in the areas that may trap the granular material 350, thereby urging the remaining granular material 350 to exit the discharge valve 320.

Discharge bladder 340 may inflate automatically, for example by using input from a sensor that determines the amount of granular material 350 remaining in the expandable container 100. In this embodiment discharge bladder 340 may be connected to a built-in pump provided within, or attached to, the expandable container 100. In other embodiments the discharge bladder 340 can be inflated manually by attaching an air hose to the discharge bladder valve 170.

Figure 4B:
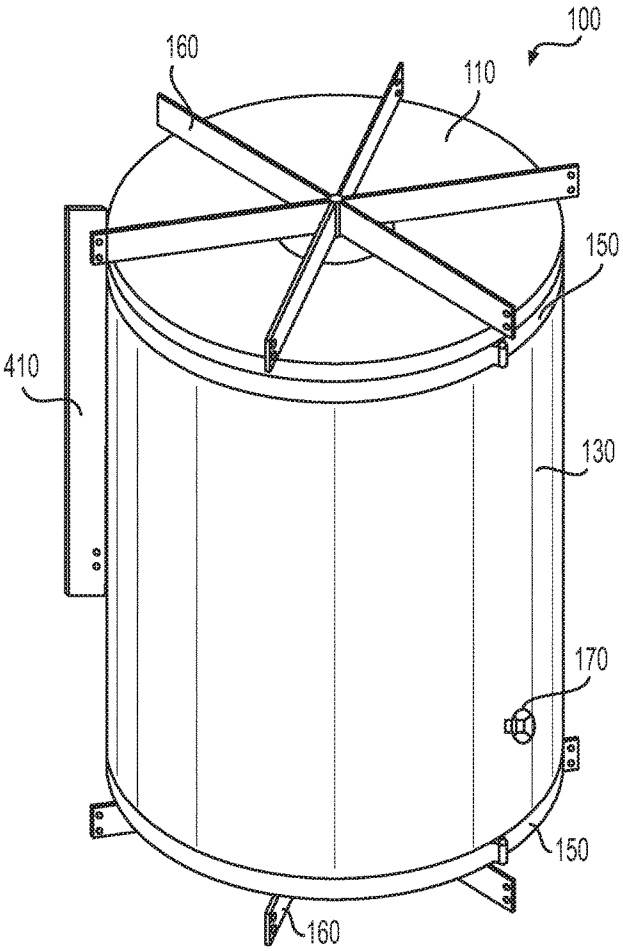
FIG. 4B is an illustration of an example embodiment of an expandable container in an expanded state.
Figure 4A:
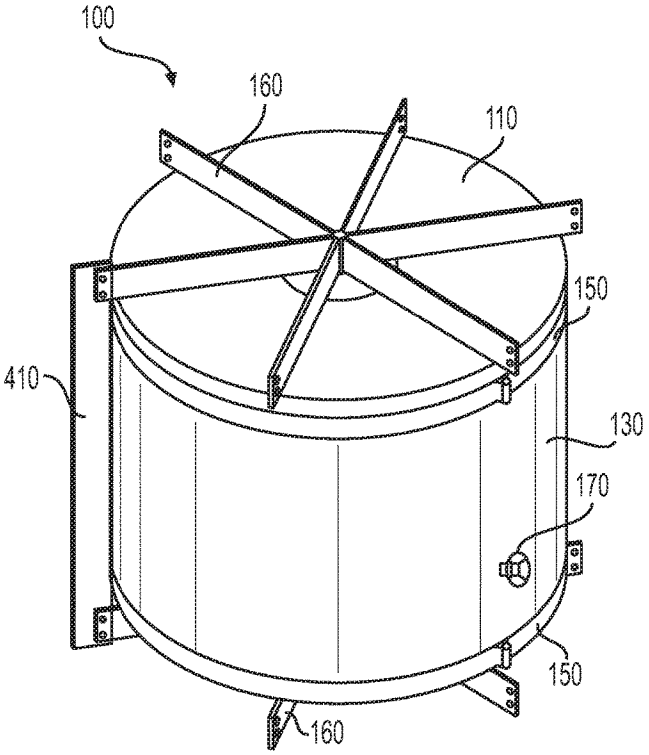
FIG. 4A is an illustration of an example embodiment of an expandable container in an unexpanded state.

FIGS. 4A and 4B each show an expandable container 100 similar to the container of FIG. 1. The expandable container 100 in FIG. 4A is shown in a collapsed or unexpanded state, whereas the expandable container 100 in FIG. 4B is shown in an expanded state. FIGS. 4A and 4B also show a restraint device 410 that can be coupled to at least one support member 160. Although only a single restraint device 410 is shown, multiple may be used. When the restraint device 410 is secured to two support members 160 associated with the top and bottom plates 110, 120, respectively (as shown in FIG. 4A), the expandable container 110 is prevented from expanding.

The unexpanded state of FIG. 4A can be useful for transporting empty containers 100 in an efficient manner. For example, thirty trucks may be sent to a worksite, with each truck carrying two expandable containers 100 filled with granular material. After depositing the granular material at the worksite, the expandable containers 100 can be secured in their unexpanded states via restraint device 410 and stacked three containers high, such that all sixty containers can be loaded onto ten trucks. This lowers the transportation cost associated with transporting granular material.

To prepare the expandable container 100 of FIG. 4A for loading, the restraint device 410 can be decoupled from one of the support members 160. As shown in FIG. 4B, for example, the restraint device 410 can be decoupled from a support member 160 associated with the bottom plate. In order to secure the restraint device 410 when it is only attached to one support member 160, a restraint strap may be provided along the side of the expandable container 100. For example, the restraint strap may be attached to the outer material 130.

Figure 5:
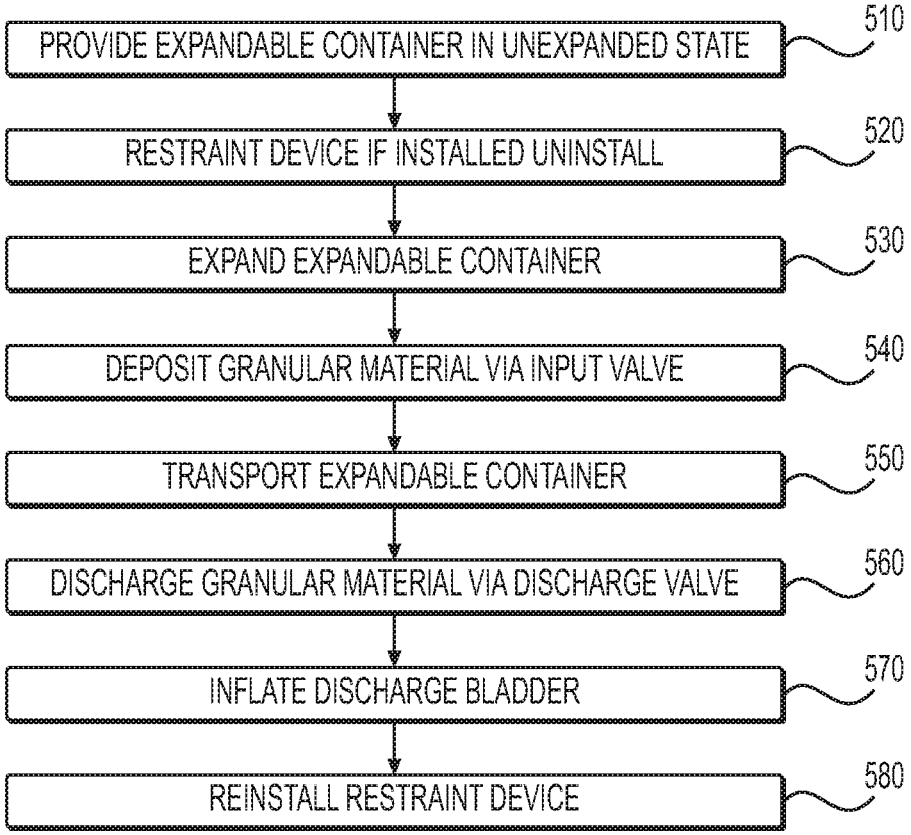
FIG. 5 is a flow chart of an example method of transporting granular material using an expandable container.

FIG. 5 provides a flow chart of an example method of transporting granular material using the expandable containers described herein. At step 510, an expandable container is provided. In the embodiment of FIG. 5, the container is provided in an unexpanded state; however, the container may be provided in either an expanded or unexpanded state at this step.

If a restraint device is installed such that the container is prevented from expanding, the restraint device is removed at step 520.

At step 530, the expandable container is expanded. This may involve, for example, lifting the expandable container using the top plate, or support members attached to the top plate, and allowing the container to expand via the weight of the bottom plate. This step may also involve some amount of vibration or movement to encourage the container to expand sufficiently.

At step 540, granular material is deposited into the expandable container via an input valve. This step may occur simultaneously with step 530, or may occur after step 530. For example, when the expandable container is lifted from the top plate, pouring sand into the lifted container can provide enough weight to cause the bottom of the container to expand downward. Step 540 includes accessing the input valve by depressing the valve plate, as described with respect to FIG. 2. This step also includes supplying granular material to the expandable container, for example by using a hopper, conduit, hose, funnel, or other device that directs the granular material into the input valve. The device supplying the granular material may also depress the valve plate, or these actions may be done separately by two different devices.

Step 540 may also include vibrating or otherwise applying force to the expandable container as the granular material is deposited. The application of force spreads the granular material within the expandable container and allows for an uninterrupted flow of material into the container.

At step 550, the filled expandable container is transported to its destination. Because a filled container can be quite heavy, machinery may be used to lift the filled container and place it on a truck, ship, train car, or other transportation device. In some embodiments, the same machinery is used to expand the container at step 530 and load the container at step 550. In other embodiments separate machines are used at each step.

At step 560, the granular material is discharged from the expandable container at its desired location. Depending on the type of transport vehicle used, the filled containers may need to be removed from the transport vehicle before the granular material is discharged. To discharge the material, the container is positioned in the desired location and the valve plate of the discharge valve is depressed, as shown in FIG. 3. This opens the valve and allows material to flow from the container.

Step 570 includes inflating the discharge bladder (or bladders, if the container is equipped with more than one) such that any remaining granular material is expelled through the discharge valve. As described with respect to FIG. 3, the discharge bladder may inflate automatically based on a perceived level of material in the container, or may be inflated manually by, for example, attaching a source of compressed air to the discharge bladder valve.

At step 580, the now-empty expandable container is provided in an unexpanded state due to its lack of contents.

At this step the restraint device may be installed, or reinstalled, such that it connects to at least one support member along the top plate and one support member along the bottom plate. Once secured, the restraint device maintains the unexpanded geometry of the container. This allows for multiple unexpanded containers to be stacked on top of one another—for example, on a truck or other shipping vehicle. Once the unexpanded containers are returned to the storage location for the granular material, they may be filled again starting with Step 510.

Figure 6:
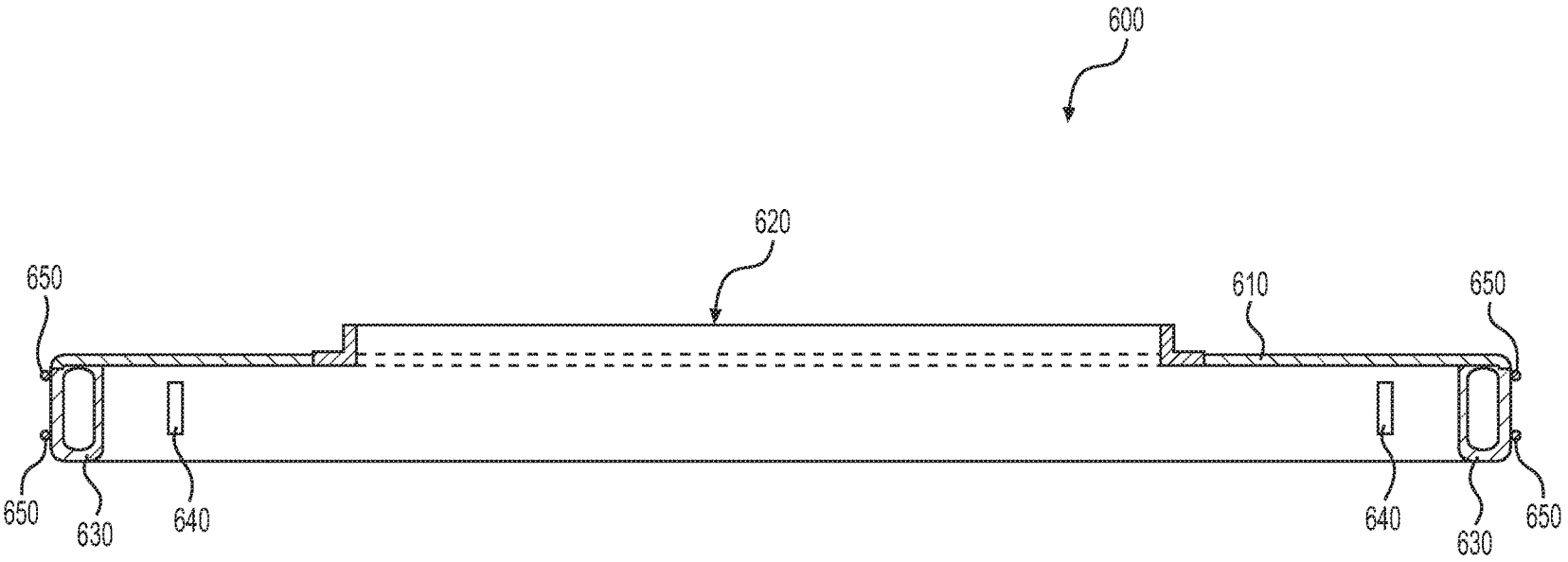
FIG. 6 is a cross-sectional illustration of a portion of a container in accordance with an example embodiment.

FIG. 6 provides a cross-sectional illustration of a container top 600 in accordance with an example embodiment. The top 600 can also be referred to as a top plate, upper portion, top portion, or lid. The top 600 can include a metal plate 610 that provides the basic shape and structure of the top 600. The metal plate 610 can be circular, square, rectangular, or any other shape. In the example of FIG. 6, the plate 610 is substantially circular in shape.

The top 600 can include an opening 620 in the center of the top 600. The opening 620 can include any mechanism for receiving sand or other granular material. For example, the opening 620 can be a valve, an inlet, a funnel, or simply an opening the plate through which granular material can be poured.

The top 600 can include a reinforcement ring 630 that provides strength and rigidity to the top 600, as well as providing mounting points for various features and mechanisms of the overall container. As shown in FIG. 6, the reinforcement ring 630 can be a hollow metal bar coupled to the metal plate 610. The reinforcement ring 630 of FIG. 6 has a predominantly rectangular cross-sectional shape, although any other shape can be used.

The reinforcement ring 630 can be coupled to the metal plate 610 via welding, adhesives, epoxy, or can be cast or forged as one piece with the metal plate 610. In one example, the walls of the reinforcement ring 630 are made from 3/16-inch steel, and the reinforcement ring 630 itself is approximately 6 by 2 inches in cross section. In one example, the material used for the reinforcement ring 630 is rated at approximately 50 KSI. Of course, the reinforcement ring 630 can be made from other materials, in different shapes or sizes, or with different wall thicknesses.

The reinforcement ring 630 can also include one or more slots 640 configured to receive lift tubes (not shown) or other attachments. The lift tubes are discussed further with respect to FIG. 8. The slots 640 can be positioned such that three or four, or more, slots 640 are positioned equidistant from one another along the reinforcement ring 630. The slots 640 can extend through one or both layers of the reinforcement ring 630, depending on the type of attachment to be used for the slots 640.

The reinforcement ring 630 can also include at least one clamp ring 650 coupled to the reinforcement ring 630. In some examples, the clamp ring 650 is attached to a portion of the top 600 other than the reinforcement ring 630, such as an outer wall. In the example of FIG. 6, the top 600 includes a pair of clamp rings 650. These rings 650 can be can be made from a strong material such as metal. For example, the clamp rings 650 can be made from ½-inch diameter steel bars welded to the top 600. In the example of FIG. 6, the clamp rings 650 are welded to the reinforcement ring 630. The clamp rings 650 can be used in conjunction with a compression strap to mount one or more fabric layers, as discussed with respect to FIGS. 9 and 10.

Figure 7A:
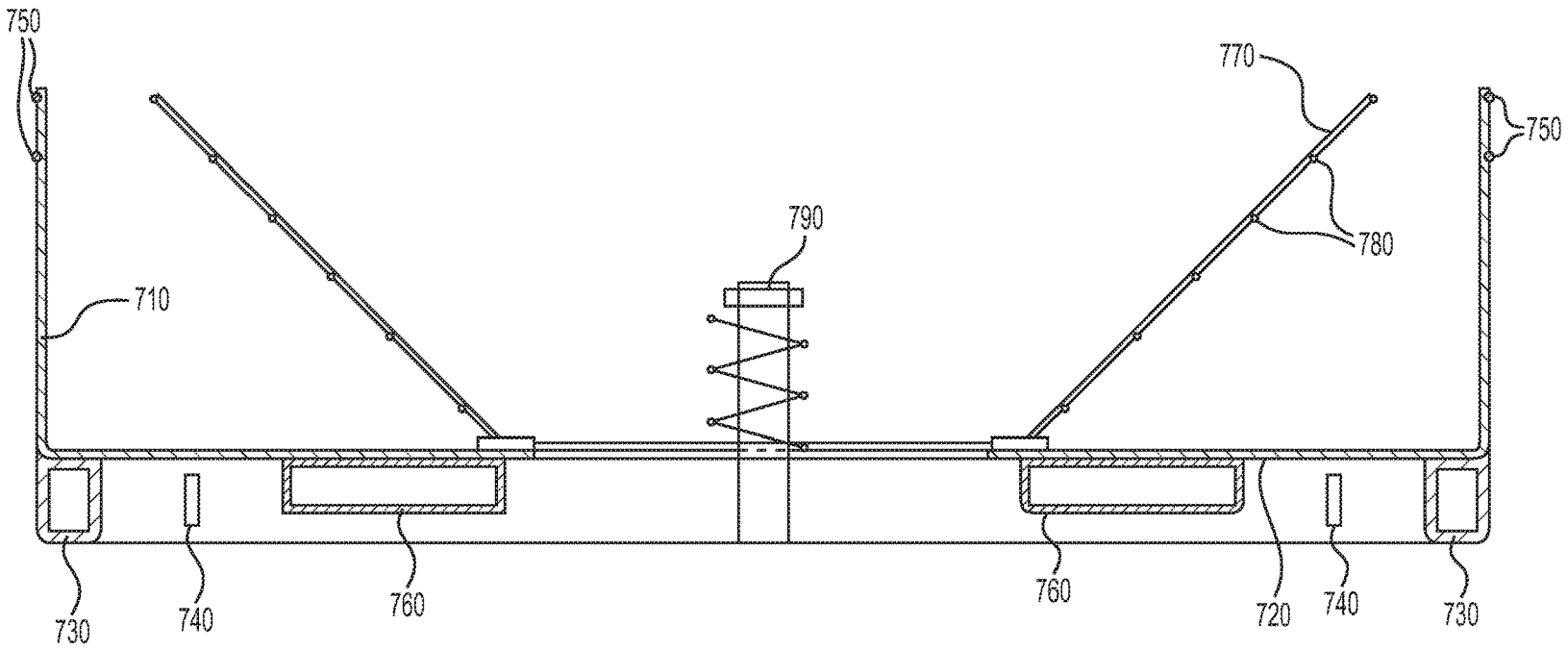
FIG. 7A is a cross-sectional illustration of a portion of a container in accordance with an example embodiment.

FIG. 7A provides a cross-sectional illustration of a container base 700 in accordance with an example embodiment. The base 700 can also be referred to as a bottom, bottom plate, lower portion, and so on. The base 700 can include a metal base plate 720 and metal side plate 710. In some embodiments, the metal base plate 720 and side plate 710 are formed from the same piece of metal or welded to one another. The side and base plates 710, 720 can have the same or different thicknesses. In one example, both plates 710, 720 are made from ⅛-inch steel. Any other thickness or material can be used.

The base 700 can include a reinforcement ring 730 that provides strength and rigidity to the base 700, as well as providing mounting points for various features and mechanisms of the overall container. As shown in FIG. 7A, the reinforcement ring 730 can be a hollow metal bar coupled to the metal base plate 720. The reinforcement ring 730 of FIG. 7A has a predominantly rectangular cross-sectional shape, although any other shape can be used.

The reinforcement ring 730 can be coupled to the metal base plate 720 via welding, adhesives, epoxy, or can be cast or forged as one piece with the metal base plate 720. In one example, the walls of the reinforcement ring 730 are made from 3/16-inch steel, and the reinforcement ring 730 itself is approximately 6 by 2 inches in cross section. In one example, the material used for the reinforcement ring 730 is rated at approximately 50 KSI. Of course, the reinforcement ring 730 can be made from other materials, in different shapes or sizes, or with different wall thicknesses.

The reinforcement ring 730 can also include one or more slots 740 configured to receive lift tubes (not shown) or other attachments. The lift tubes are discussed further with respect to FIG. 8. The slots 740 can be positioned such that three or four, or more, slots 740 are positioned equidistant from one another along the reinforcement ring 730. The slots 740 can extend through one or both layers of the reinforcement ring 730, depending on the type of attachment to be used for the slots 740.

The side plate 710 can include at least one clamp ring 750 coupled to the side plate 710. In some examples, the clamp ring 750 is attached to a portion of the reinforcement ring 730 rather than the side plate 710. In the example of FIG. 7A, the base 700 includes a pair of clamp rings 750. These rings 750 can be can be made from a strong material such as metal. For example, the clamp rings 750 can be made from ½-inch diameter steel bars welded to the base 700. In the example of FIG. 7A, the clamp rings 750 are welded to the side plate 710. The clamp rings 750 can be used in conjunction with a compression strap to mount one or more fabric layers, as discussed with respect to FIGS. 9 and 10.

FIG. 7A also depicts a pair of fork lift tubes 760 extending along the base plate 720. The fork lift tubes 760 can also be referred to as boots or fork lift boots. The fork lift tubes 760 can be sized to accept fork lift prongs. For example, the fork lift tubes 760 can be approximately 12 inches by 4 inches in diameter, using %-inch thick steel. The fork lift tubes 760 can be welded to the base plate 720 and/or the reinforcement ring 730, and can extend through the reinforcement ring 730 in some examples. The fork lift tubes also provide additional strength and rigidity to the base plate, which bears the greatest stress during lifting.

FIG. 7A also shows a valve 790 that can be used to control the flow of sand or other granular material from the container. The valve can be pneumatically or hydraulically actuated via an actuator mounted to a location on the container itself, such as a portion of the base 700, or mounted at an external location such as the frame of a vehicle or other device.

A bladder can be positioned within the container, such as the bladder 340 shown in FIG. 3, to help push all granular material within the container toward the valve 790. To prevent the bladder from interfering with the operation of the valve 790, the container can incorporate a barrier 770. The barrier 770 can be any component or group of components that prevents the bladder from interfering with the valve 790 but also allows the free flow of granular material.

In one example, the barrier 770 can include a plurality of members mounted proximate the valve 790. For example, FIG. 7A shows at least two members 770 mounted proximate the valve 790. The members 770 are positioned such that as they extend away from their mounting location, they extend toward the sides of the container and away from the central axis of the container. This allows the bladder to expand without interfering with the operating of the valve 790.

In some examples, the members 770 are connected via barrier rings 780. The barrier rings 780 can be metal rings that are mounted to multiple members 770, such as via welding, adhesives, epoxy, or mechanical fasteners. The rings 780 and members 770 can collectively form a frustoconical basket or mesh barrier. that limits expansion of the bladder while allowing granular material to exit the container through the valve 790.

Figure 7B:
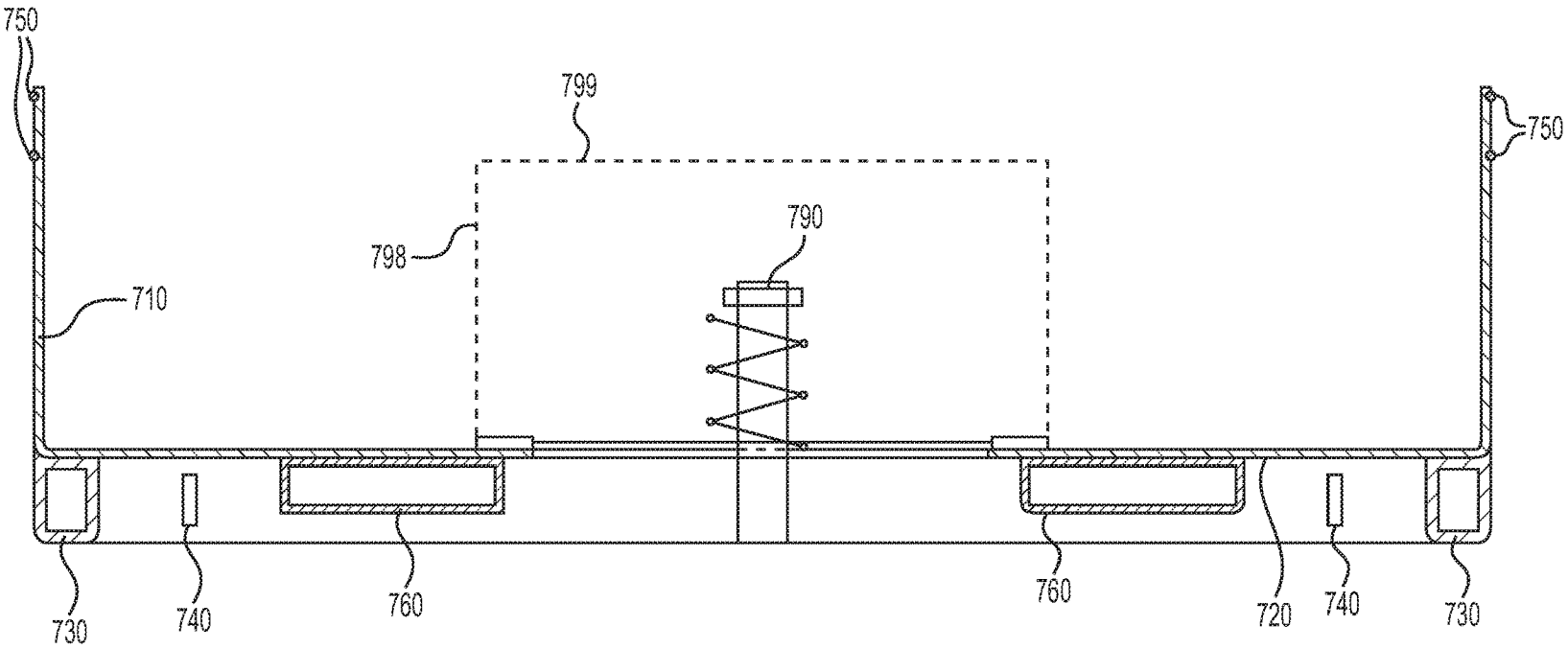
FIG. 7B is a cross-sectional illustration of a portion of a container in accordance with an example embodiment.

FIG. 7B provides an example portion of a container similar to FIG. 7A, but with a different mechanism for preventing the fabric liner from interfering with the operation of the valve 790. As in FIG. 7A, the example of FIG. 7B includes a base 700 with a base plate 720 and side plate 710, and a reinforcement ring 730 coupled to the base plate 720. The container also includes clamp rings 750, fork lift tubes 760, and a valve 790.

FIG. 7B includes a barrier 798 that at least partially surrounds the valve 790. In this example, the barrier 798 is a perforated metal pipe. The pipe can include a plurality of apertures through the sidewalls of the pipe. The cumulative area of the apertures can be matched to support a desired flow rate of granular material from the valve 790. For example, a larger cumulative area of apertures would provide a higher flow rate than a smaller cumulative area of apertures. In some examples, the apertures are sized large enough to prevent clogs due to clumps of granular material.

Although the barrier 798 is described as a metal pipe, other types of shapes and materials can be used as well. For example, the barrier 798 can be a PVC pipe. In another example, the barrier 798 is a box with four sides. The barrier 798 can be mounted to the base plate 720 via welding, epoxy, fasteners, or any other suitable methods.

Regardless of its shape, the barrier 798 can include a perforated lid 799 coupled to the barrier 798. The lid 799 can be made from a similar material as the barrier 798 and can include similar perforations. The lid 799 can be coupled using any suitable methods. In some examples, the lid 799 can be removably coupled to the barrier 798 such that it provides easy access to the valve 790 for maintenance or other needs. For example, the lid 799 can be a cap that screws down onto the barrier 798. In another example, the lid 799 includes mounting locations where the lid 799 and barrier 798 interface with one another and can be coupled via, for example, mechanical fasteners.

The barrier 798 of FIG. 7B provides additional options for transporting materials. For example, rather than transporting a granular material, the container can be used to transport a liquid. In that scenario, a removable bladder can be mounted to the top 600 of the container and filled with liquid rather than granular material. The liquids may be production or flow-back water, or crude gathered at the production site. This eliminates the need for a tank truck round trip by utilizing the empty return leg of the sand containers. As the bladder is filled with liquid, it expands inside the container until it fills all available space inside container. The barrier 798 and cap 799 can be positioned to prevent the liquid bladder from interfering with the valve 790. When the container arrives at the intended destination, the liquid can be pumped out of the container.

Figure 8:
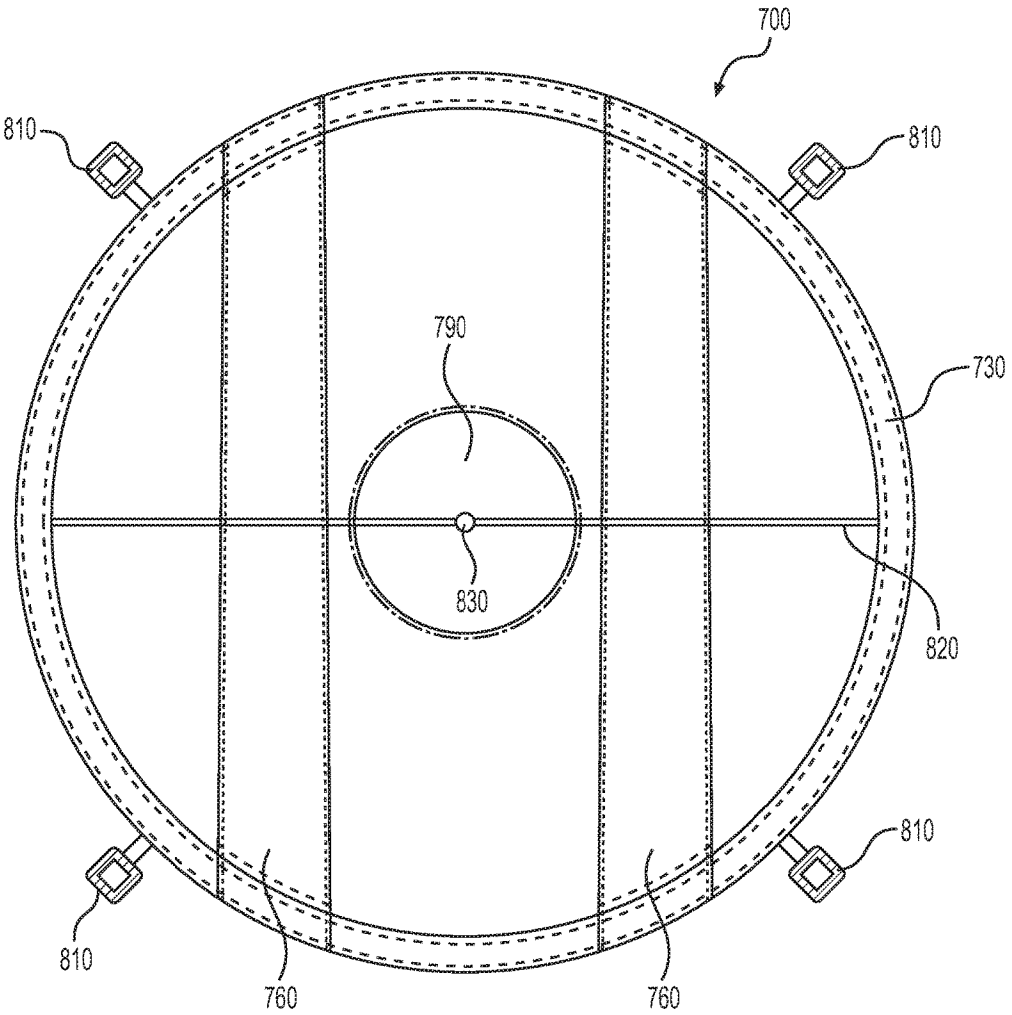
FIG. 8 is an illustration of a portion of a container in accordance with an example embodiment.

FIG. 8 provides an illustration of a bottom-up view of the base 700. The illustration shows the reinforcement ring 730 along the perimeter of the base 700 that provides additional strength and rigidity to the base 700. The drawing also shows the fork lift tubes 730 extending through the reinforcement ring 730. The fork lift tubes 730 are positioned such that they do not interfere with the valve 790 in the center of the base 700. The fork lift tubes 730 are also open on both ends, allowing fork lift access from either direction.

The valve 790 can include a valve stem 830 in the center of the valve plate, providing a stable base upon which the valve 790 can open and close. The valve stem 830 can be stabilized by the stabilizer beam 820. In the example of FIG. 8, the base 700 includes one stabilizer beam 820 that extends across the base 700, from a first location on the inside of the reinforcement ring 730 to a second location on the inside of the reinforcement ring 730. The stabilizer beam 820 can also be considered two stabilizer beams 830, with the first beam extending from a first location on an inside surface of the reinforcement ring 730 to the valve stem 830, and the second beam extending from a second location on the inside surface of the reinforcement ring 730 to the valve stem 830. The stabilizer beam 830 can be welded to the reinforcement ring 730, valve stem 830, base plate 720, fork lift tubes 760, or any combination thereof. Other methods of coupling, such as mechanical fastening, epoxy, or adhesive, can be used to secure the stabilizer beam 830.

FIG. 8 also shows four lift tubes 810 installed in the base 700. Each lift tube 810 can interface with a slot 740 in the reinforcement ring 730. The slot 740 can pass through one or both walls of the reinforcement ring 730, and the lift tubes 810 can be designed to interface accordingly. In one example, the lift tubes 810 are designed to be installed at an angle to the surface of the base 700, and then rotated parallel to the base 700 to be locked in place. In another example, the lift tubes 810 are inserted through both walls of the reinforcement ring 730 and then a mechanical fastener is applied to prevent the lift tube from 810 from pulling out.

The lift tubes 810 can be made in any shape and from any material, but in the example of FIG. 8 they include two pieces made from steel. The first piece is a four-inch by four-inch hollow section made from ⅜-inch steel. The first section is connected to the second piece, which is a clip made from solid ¾-inch-thick steel. The lift tubes 810 can be included in the base 700 of the container, the top 600 of the container, or both.

The lift tubes 810 can be used to lift the container, such as by attaching cables to the lift tubes 810 and pulling the cables to lift the container. The container can be lifted via the lift tubes 810 associated with the base 700 of the container, the lift tubes 810 associated with the top 600 of the container, or some combination thereof. The container can also be lifted using all of the lift tubes 810 or some subset of lift tubes 810, depending on the number of lift tubes 810 and their orientation. In some examples, both the base 700 and top 600 of the container each include three or four lift tubes 810. In other examples, more lift tubes 810 can be used. The lift tubes 810 can also be used to secure the container in a vehicle or other transportation by attaching cables, straps, locks, or any other mechanism to the lift tubes 810. Incorporated into each lift tube 810 can be a cam lock receiver. Screw cams can be utilized in a lifting apparatus and/or the bed or a truck or rail car. The screw cams can interface and lock into the cam lock receivers to perform lifting operations or to secure the container.

Figure 9:
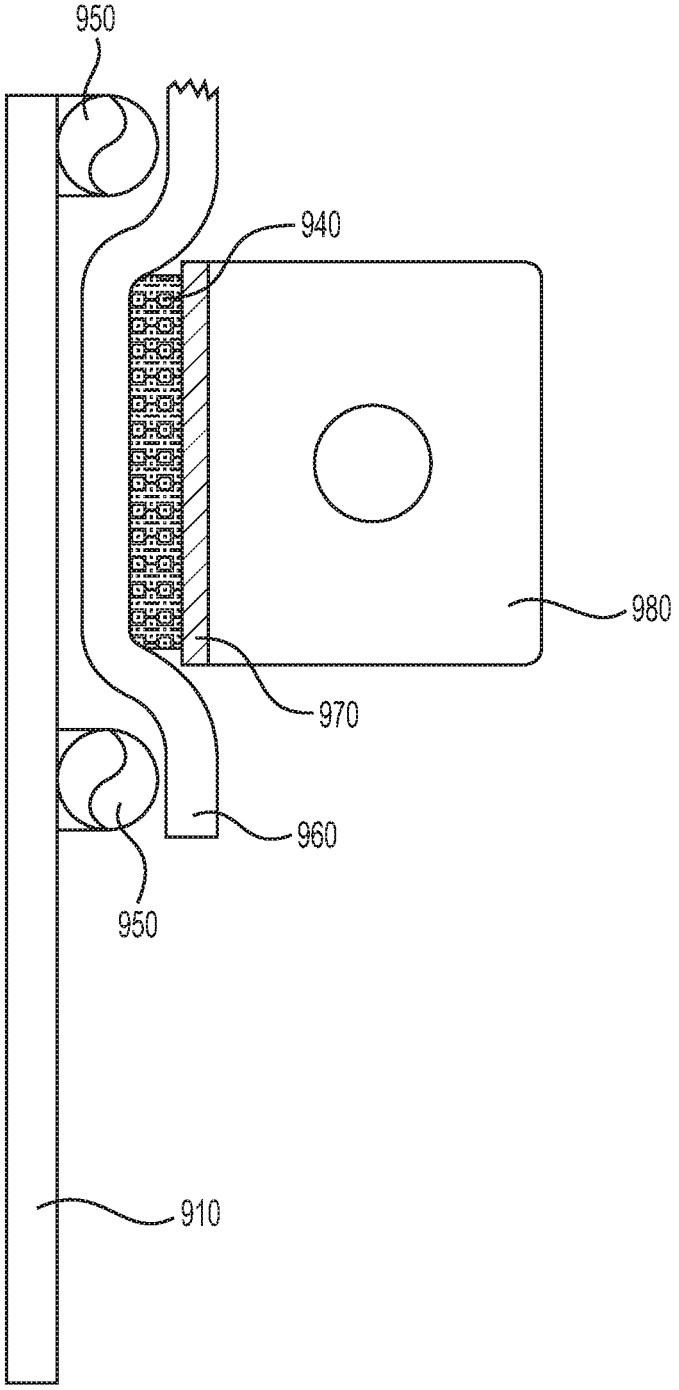
FIG. 9 is an illustration of an example pair of clamp rings with a compression strap.

FIG. 9 provides an illustration of clamp rings 950 that can be used to mount fabric sleeves or other components to the container. In the example of FIG. 9, a container wall 910 is shown having two clamp rings 950 mounted to it. The container wall 910 can be, for example, the reinforcement ring 630 of FIG. 6 or 7, or the side wall 710 of FIG. 7A, for example. The clamp rings 950 can be welded to the container wall 910. The clamp rings 950 can be solid metal rings. In the example of FIG. 7A, the clamp rings 950 are ¾-inch diameter, although other sizes can be used. The clamp rings 950 can be spaced apart to allow for one or more compression straps 970 to be used. For example, the clamp rings 950 can be spaced apart by about 2-6 inches in one example.

FIG. 9 shows a fabric sleeve 960 positioned such that it abuts the container wall 910 between the pair of clamp rings 950. One or more compression straps 970 can be placed over the fabric sleeve 960, also positioned between the pair of clamp rings 950. The compression straps 970 can include, for example, a nylon hearty web strap that contacts the fabric sleeve 960. The compression straps 970 can also include a steel compression strap positioned over the nylon strap. The steel compression strap can have a thickness of about 3/16-inch in one example.

The steel compression strap can also include a connection 980 that extends outwardly from the straps 970 and container wall 910, allowing for bolts or other fasteners to be utilized. For example, the steel compression strap can include two connections 980 that require a large amount of force to press together. In that example, an operator can install the steel compression strap, align the two connections 980, and insert a bolt of sufficient length through both. The operator can then install a nut on the bolt and tighten the nut, slowly forcing the two connections 980 toward each other. In some examples, the steel compression strap can include multiple sections that each include connections 980 and both ends. In those examples, the steel compression strap can require two, three, four, or more fasteners to fasten the connections 980 to one another accordingly.

Figure 10:
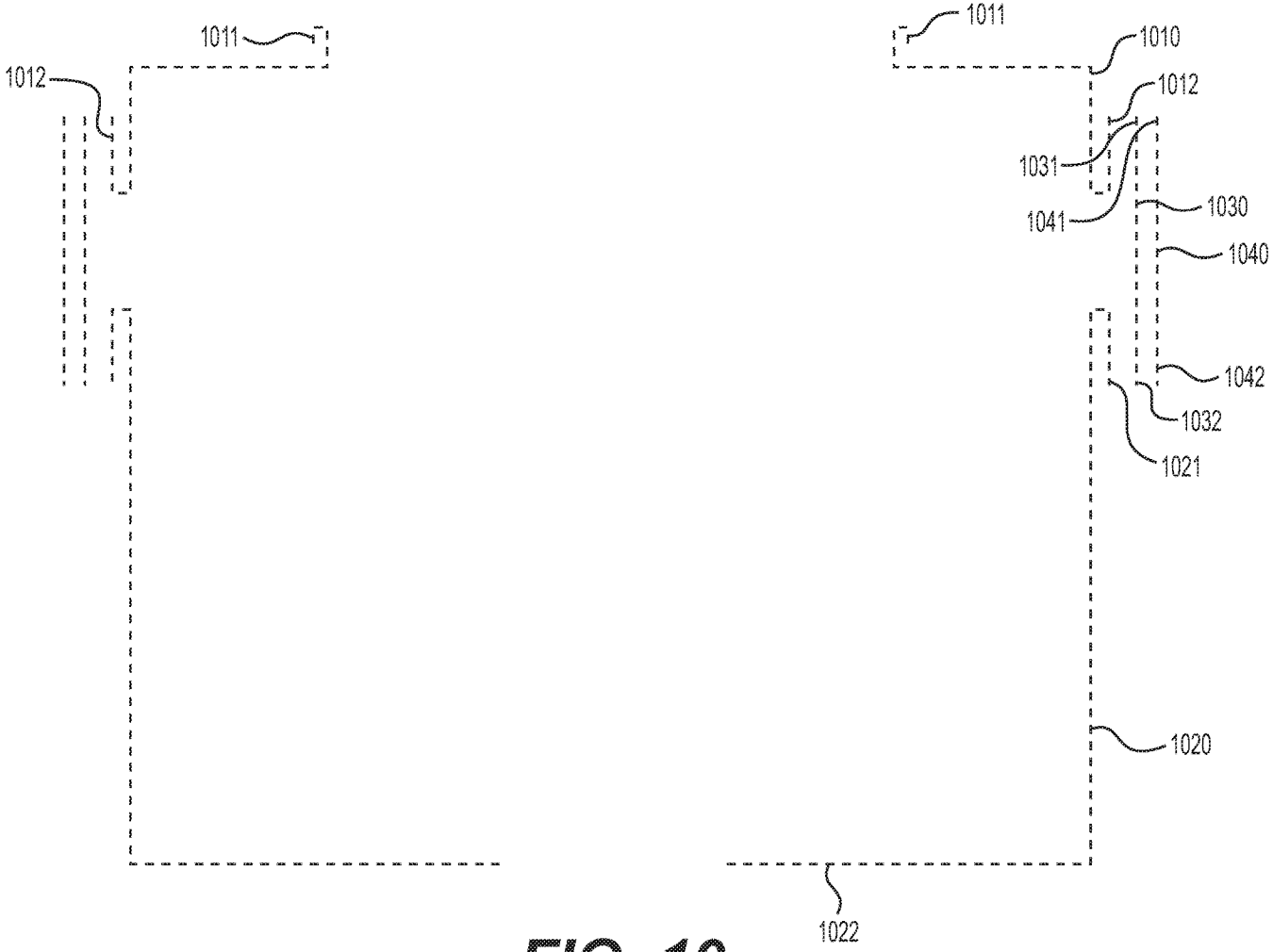
FIG. 10 is a diagram depicting a representation of fabric sleeves an illustration of a portion of a container in accordance with an example embodiment.

FIG. 10 is a representative illustration of multiple fabric sleeves that can be used to contain sand or other granular material in the container. The fabric sleeves can line the inside of the container and can also be used to couple the top 600 and base 700 to one another. As explained above, the fabric sleeves can be made from a strong material such as Kevlar. Four fabric sleeves 1010, 1020, 1030, and 1040 are shown in FIG. 10. Each fabric sleeve can have a first opening and a second opening, as described in more detail below. An opening can be an open end of the sleeve or any other type of opening in the sleeve. Moreover, although the term "sleeve" is used to describe the fabric, that term is not intended to be limiting in any way. The fabric can take any shape or form that accomplishes any of the description provided herein.

The first sleeve 1010 can have an upper opening 1011 and a lower opening 1012. In the example of FIG. 10, the upper opening 1011 is located proximate the opening 620 in the top 600. The first sleeve 1010 can be coupled to the top 600 via the upper opening 1011 by, for example, clamping the upper opening 1011 to the opening 620 of the top 600. It can also be clamped to a different portion of the top 600, such as to a mounting point designed to accommodate the first sleeve 1010 and an associated clamping mechanism. The lower opening 1012 of the first sleeve 1010 can be wrapped around the reinforcement ring 630 of the top 600 and then coupled to clamp rings 650, using the methods described in FIG. 9. Although the description herein may refer to clamping or otherwise coupled an upper or lower opening of the fabric sleeves, this does not mean that the edges of the fabric sleeves need to be clamped or coupled. Instead, any portion of the sleeve proximate the openings can be clamped or coupled, which would be understood as clamping or coupling the "openings."

Continuing with FIG. 10, the second sleeve 1020 can be coupled to the base 700 of the container using similar methods. The second sleeve 1020 can include an upper opening 1021 and a lower opening 1022. The upper opening 1021 can be coupled to the base 700 via a pair of clamp rings 750, using the methods described in FIG. 9. The lower opening 1022 can be coupled to the base 700 proximate the valve 790. For example, the lower opening 1022 can be wrapped around the perimeter of the valve 790 such that granular material within the second sleeve 1020 exits the valve 790 without contacting the metal base plate 720.

The top 600 and base 700 can be coupled to one another via the third sleeve 1030 and, optionally, a fourth sleeve 1040 for additional strength and reinforcement. As shown in FIG. 10, the third sleeve 1030 can include an upper opening 1031 and a lower opening 1032. The upper opening 1031 can be coupled to the same mounting location as the lower opening 1012 of the first sleeve 1010. For example, the upper opening 1031 of the third sleeve 1030 can be positioned on top of, and overlapping with, the lower opening 1012 of the first sleeve 1010, positioned between a pair of clamp rings 650 associated with the top 600. Both sleeves can be secured at that location using the same clamping mechanism, such as the mechanisms described with respect to FIG. 9.

Similarly, the lower opening 1032 of the third sleeve 1030 can be secured to the base 700 at the same location as the upper opening 1021 of the second sleeve 1020. For example, the lower opening 1032 of the third sleeve 1030 can be positioned on top of, and overlapping with, the upper opening 1021 of the second sleeve 1020, positioned between a pair of clamp rings 750 associated with the base 700. Both sleeves can be secured at that location using the same clamping mechanism, such as any of the mechanisms described with respect to FIG. 9.

The fourth sleeve 1040 can be layers on top of the third sleeve 1030 in a similar manner, providing extra support and reinforcement for the container. The fourth sleeve 1040 can include an upper opening 1041 and a lower opening 1042. The upper opening 1041 can be can be coupled to the same mounting location as the lower opening 1012 of the first sleeve 1010 and the upper opening 1031 of the third sleeve 1030. For example, the upper opening 1041 of the fourth sleeve 1040 can be positioned on top of, and overlapping with, the lower opening 1012 of the first sleeve 1010 and the upper opening 1031 of the third sleeve 1030, positioned between a pair of clamp rings 650 associated with the top 600. All three sleeves can be secured at that location using the same clamping mechanism, such as the mechanisms described with respect to FIG. 9.

Similarly, the lower opening 1042 of the fourth sleeve 1040 can be secured to the base 700 at the same location as the upper opening 1021 of the second sleeve 1020 and the lower opening 1032 of the third sleeve 1030. For example, the lower opening 1042 of the fourth sleeve 1040 can be positioned on top of, and overlapping with, the upper opening 1021 of the second sleeve 1020 and the lower opening 1032 of the third sleeve 1030, positioned between a pair of clamp rings 750 associated with the base 700. All three sleeves can be secured at that location using the same clamping mechanism, such as any of the mechanisms described with respect to FIG. 9.

By using multiple sleeves as described above, the container can remain lightweight and cost effective while providing a sealed and secure environment for granular material being shipped. When empty, the containers can collapse to a smaller size due to the flexibility of the fabric sleeves. The sleeves do not compromise the overall strength of the container, as it could still be lifted from the top or bottom as desired.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A container for granular material, comprising:

a top plate having an inlet;

a bottom plate having an outlet;

a first fabric sleeve having a first open end and a second open end, the first open end coupled to the inlet of the top plate and the second open end coupled to an upper mounting location of the top plate;

a second fabric sleeve having a third open end and a fourth open end, the third open end coupled to the outlet of the bottom plate and the fourth open end coupled to a lower mounting location of the bottom plate; and a third fabric sleeve having a fifth open end and a sixth open end, the fifth open end coupled to the second open end of the first fabric sleeve via the upper mounting location of the top plate, and the sixth open end coupled to the fourth open end of the second fabric sleeve via the lower mounting location of the bottom plate, wherein the upper and lower mounting locations each comprise a pair of clamp rings spaced to receive a compression strap therebetween.

2. The container of claim 1, further comprising a discharge bladder that, when inflated, biases granular material within the container toward the outlet.

3. The container of claim 2, further comprising a barrier positioned proximate the outlet such that the barrier prevents at least a portion of the discharge bladder from entering the outlet.

4. The container of claim 3, wherein the barrier is porous, such that granular material can flow through the barrier.

5. The container of claim 3, wherein the barrier is a plurality of members positioned proximate the outlet.

6. The container of claim 5, wherein at least one of the members is mounted such that it extends away from the outlet, wherein a proximate end of the member is positioned closer to a longitudinal axis of the container than a distal end of the member.

7. The container of claim 5, wherein the barrier comprises at least one ring mounted to at least two of the plurality of members.

8. A sealed container for granular material, comprising:

a rigid upper portion having an inlet;

a rigid bottom portion having an outlet;

a first fabric sleeve having a first open end and a second open end, the first open end coupled to the inlet of the upper portion and the second open end coupled to an upper mounting location of the upper portion;

a second fabric sleeve having a third open end and a fourth open end, the third open end coupled to the outlet of the bottom portion and the fourth open end coupled to a lower mounting location of the bottom portion; and a third fabric sleeve having a fifth open end and a sixth open end, the fifth open end coupled to the second open end of the first fabric sleeve via the upper mounting location of the upper portion, and the sixth open end coupled to the fourth open end of the second fabric sleeve via the lower mounting location of the bottom portion, wherein the upper and lower mounting locations each comprise a pair of clamp rings spaced to receive a compression strap therebetween.

9. The container of claim 8, further comprising a fourth fabric sleeve having a seventh open end and an eighth open end, the seventh open end coupled to the fifth open end of the third fabric sleeve and the second open end of the first fabric sleeve via the upper mounting location of the upper portion, and the eighth open end coupled to the sixth open end of the third fabric sleeve and the fourth open end of the second fabric sleeve via the lower mounting location of the bottom portion.

10. The container of claim 8, wherein coupling to the upper or lower mounting location comprises compressing a portion of at least one of the first, second, or third fabric sleeves between the pairs of clamp rings via a compression strap.

11. The container of claim 10, wherein the compression strap is made from metal.

12. The container of claim 8, wherein the first, second, and third fabric sleeves are made from a Kevlar-based or Kevlar-reinforced material.

13. The container of claim 8, wherein the first, second, and third fabric sleeves comprise a material impermeable to moisture.

14. A container for liquid material, comprising:

a cylindrical top plate having an inlet;

a cylindrical bottom plate having an outlet;

a first fabric sleeve having a first open end and a second open end, the first open end coupled to the inlet of the top plate and the second open end coupled to an upper mounting location of the top plate a second fabric sleeve having a third open end and a fourth open end, the third open end coupled to the outlet of the bottom plate and the fourth open end coupled to a lower mounting location of the bottom plate; and a third fabric sleeve having a fifth open end and a sixth open end, the fifth open end coupled to the second open end of the first fabric sleeve via the upper mounting location of the top plate, and the sixth open end coupled to the fourth open end of the second fabric sleeve via the lower mounting location of the bottom plate, wherein the upper and lower mounting locations each comprise a pair of clamp rings spaced to receive a compression strap therebetween.

15. The container of claim 14, further comprising a bladder removably coupled to the top plate and configured to retain liquid.

16. The container of claim 14, wherein the top plate comprises a hollow metal tube coupled along a perimeter of the top plate.

17. The container of claim 14, wherein the bottom plate comprises a pair of fork lift boots positioned on either side of the outlet.

18. The container of claim 14, wherein the top plate comprises a plurality of slots, each slot configured to couple to a lift tube for lifting or anchoring the container.

19. The container of claim 17, wherein the pair of fork lift boots are each accessible from either end of the fork lift boots.

* * * * *